United States Patent [19]

Hosaka

[11] Patent Number: 4,483,244

[45] Date of Patent: Nov. 20, 1984

[54] RICE WHITENING APPARATUS

[75] Inventor: Yukio Hosaka, Higashihiroshima, Japan

[73] Assignee: Satake Engineering Co., Ltd., Tokyo, Japan

[21] Appl. No.: 558,628

[22] Filed: Dec. 6, 1983

[30] Foreign Application Priority Data

Dec. 13, 1982 [JP] Japan ..... 57-216872
Dec. 13, 1982 [JP] Japan ..... 57-216873

[51] Int. Cl.[3] ..... B02B 3/00; B02C 25/00

[52] U.S. Cl. ..... 99/488; 99/600; 99/609; 241/34; 356/73

[58] Field of Search ..... 99/468, 486, 488, 489, 99/518–520, 524, 600–602, 609–611, 617–622, 646 R; 426/483, 482, 231; 241/6, 7, 33, 34, 35, 36; 34/56, DIG. 4; 329/144, 146, 147, 155, 207, 178, 179; 356/237, 239, 73, 432, 435; 250/223 R, 560, 570; 209/576, 588

[56] References Cited

U.S. PATENT DOCUMENTS 3,197,647 7/1965 Fraenkel ..... 250/225
3,871,774 3/1975 Murata ..... 356/239 X

FOREIGN PATENT DOCUMENTS 5351788 10/1976 Japan ..... 99/600

OTHER PUBLICATIONS

Matthews et al., "Relation Between Head Rice Yields and Defective Kernals in Rough Rice", Oct. 1970, vol. 73, No. 10, pp. 6–12.

*Primary Examiner*—Timothy F. Simone
*Attorney, Agent, or Firm*—Wegner & Bretschneider

[57] ABSTRACT

Disclosed is a rice whitening apparatus which is capable of indicating a degree of milling. The rice whitening apparatus comprises a first sensor means (1), a second sensor means (1'), a calculating means (20*a*) and an indicating means (23). The first sensor means (1) includes a first reflected light receiving sensor (6) for measuring a degree of reflected light from the brown rice, while the second sensor means (1') includes a second reflected light receiving sensor (6') for measuring a degree of reflected light from the milled rice. The first sensor means (1) may include a first transmitted light receiving sensor (5) for measuring a degree of transmitted light from the brown rice, while the second sensor means (1') a second transmitted light receiving sensor (5') for measuring a degree of transmitted light from the milled rice. The calculating means (20*a*) calculates the degree of milling of the rice based on the degree of reflected light or both the degree of reflected and transmitted light from the first and second sensor means (1, 1'). The indicating means (23) indicates the degree of milling calculated by the calculating means (20*a*).

8 Claims, 8 Drawing Figures

RICE WHITENING APPARATUS

BACKGROUND OF THE INVENTION

The present invention relates to a rice whitening apparatus, and more particularly, to an improved rice whitening apparatus having a device for measuring a degree of milling of the rice being milled.

SUMMARY OF THE INVENTION

One object of the present invention is to provide a rice whitening apparatus in which a degree of milling of the rice being milled is automatically measured based on the degree of reflected light from brown rice as well as from milled rice and such degree of milling is displayed.

Another object of the present invention is to provide a rice whitening apparatus in which a degree of milling of the rice being milled is automatically measured based on both the degree of reflected light and transmitted light from brown rice as well as from milled rice and such degree of milling is displayed.

A further object of the present invention is to provide a rice whitening apparatus in which the pressure value of a pressure plate is controlled so as to control a degree of milling to a predetermined degree of milling based on the measured degree of milling.

BRIEF DESCRIPTION OF THE DRAWINGS

This invention will be more fully understood from the following detailed description of the preferred embodiments when taken in connection with the accompanying drawings, in which.

DESCRIPTION OF THE PREFERRED EMBODIMENTS

Two preferred embodiments of the rice whitening apparatus according to the present invention are respectively explained hereinafter.

Figure 1:
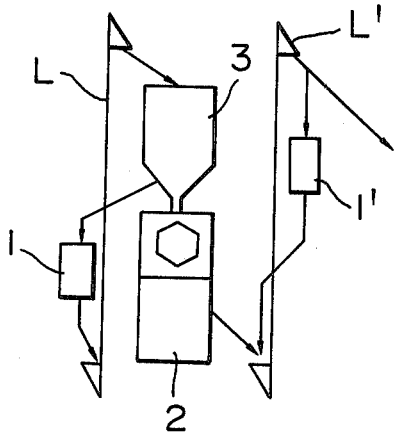
FIG. 1 is a diagrammatic view of the general arrangement of a whitening apparatus, the first and second embodiments, according to the present invention.

Referring first to FIG. 1 which diagrammatically shows the general arrangement of a whitening apparatus in accordance with the present invention, the numeral 1 represents a first sensor means for brown rice and numeral 1′ represents a second sensor means for milled rice. The numeral 2 represents a rice whitening unit and 3 represents a hopper into which the brown rice to be milled is filled after being carried up by means of a lift L. The brown rice in the hopper 3 is milled in the rice whitening unit 2. A portion of the brown rice in the hopper 3 is introduced into the sensor means 1 and the degree of reflected light of this brown rice is measured thereat. The brown rice having been measured is returned to the hopper 3 by lift L. On the other hand, a portion of the rice having been milled at the whitening unit 2 is transported by means of another lift L′ to the sensor means 1′ and the degree of reflected light of this milled rice is measured thereat in the same manner as for the brown rice.

Figure 2:
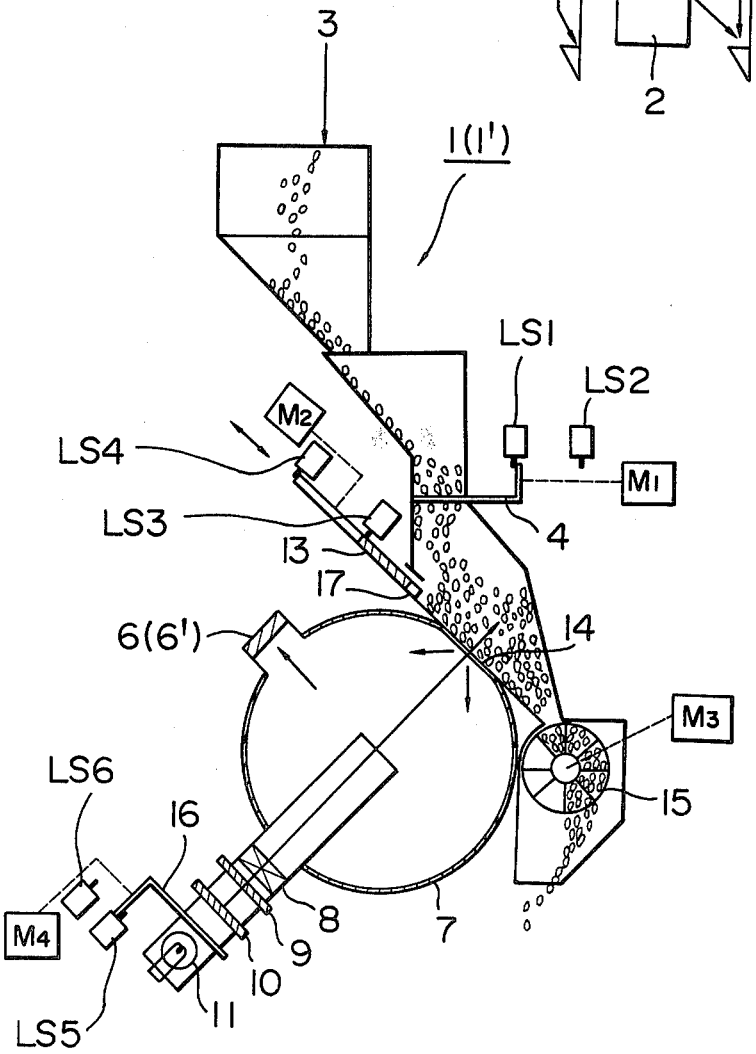
FIG. 2 is a diagrammatic view of one example of the sensor means used in the first embodiment.

FIG. 2 diagrammatically illustrates one example of the sensor means 1 for measuring the degree of reflected light of the brown rice. The sensor means 1′ for the milled rice has the same construction as the sensor means 1 and, thus, FIG. 2 shows only the sensor means 1. The sensor means 1 includes an inlet shutter 4 for blocking the rice grains from the hopper 3 to flow into a testing area; a light source lamp 11 for lighting up the rice grains through an infrared absorption filter 10, a monochromatic light filter 9 and a converging lens 8; a reflected light receiving sensor 6 for receiving a reflected light which is reflected by the rice grains and further reflected by an integrating sphere 7; a reference plate 13 for establishing a reference value for calculating the degree of milling; a rotary discharge valve 15 for discharging the rice in the testing area; a light shutter 16 for blocking the light from the light source lamp 11 to the testing area; and motors M1, M2, M3, M4 for moving the inlet shutter 4, the reference plate 13, the rotary discharge valve 15 and the light shutter 16, respectively. The sensor means 1 further includes limit switches LS1–LS6 for detecting the opening or closing of the inlet shutter 4 and the light shutter 16 and for detecting the moving in or out of the reference plate 13, respectively. The numeral 14 represents a non-reflective glass through which the grains are lighted up. The numeral 17 represents a glass cleaner fixed to the leading edge of the reference plate 13, which glass cleaner cleans the non-reflective glass 14 as the reference plate 13 moves.

Figure 3:
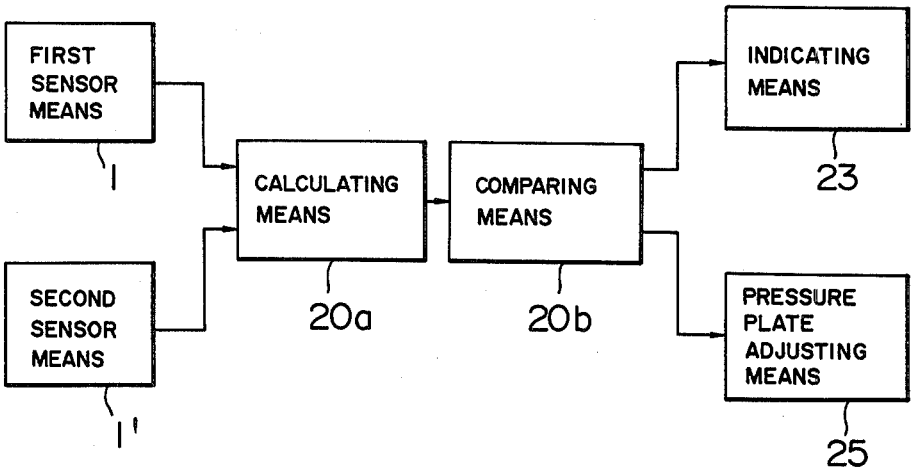
FIG. 3 is a functional diagram of some relevant elements of the present invention.

As shown in FIG. 3, the sensor means 1 (a first sensor means) which includes a first reflected light receiving sensor 6 (shown in FIG. 2) and the sensor means 1′ (a second sensor means) which includes a second reflected light receiving sensor 6′ (shown in FIG. 2) are coupled to a calculating means 20*a* with which an indicating means 23 is coupled. The calculating means 20*a* coupled with these sensor means 1, 1′ is in turn coupled to a comparing means 20*b* with which a pressure plate adjusting means 25 is coupled. In the embodiment of the present invention described herein, a CPU 20 shown in the drawings assumes the functions of the calculating means 20*a* for calculating the degree of milling of the rice based on the degree of reflected light from the first and second sensor means 1, 1′ and the functions of the comparing means 20*b* for comparing the degree of milling calculated by the calculating means 20*a* against a predetermined degree of milling.

Figure 4:
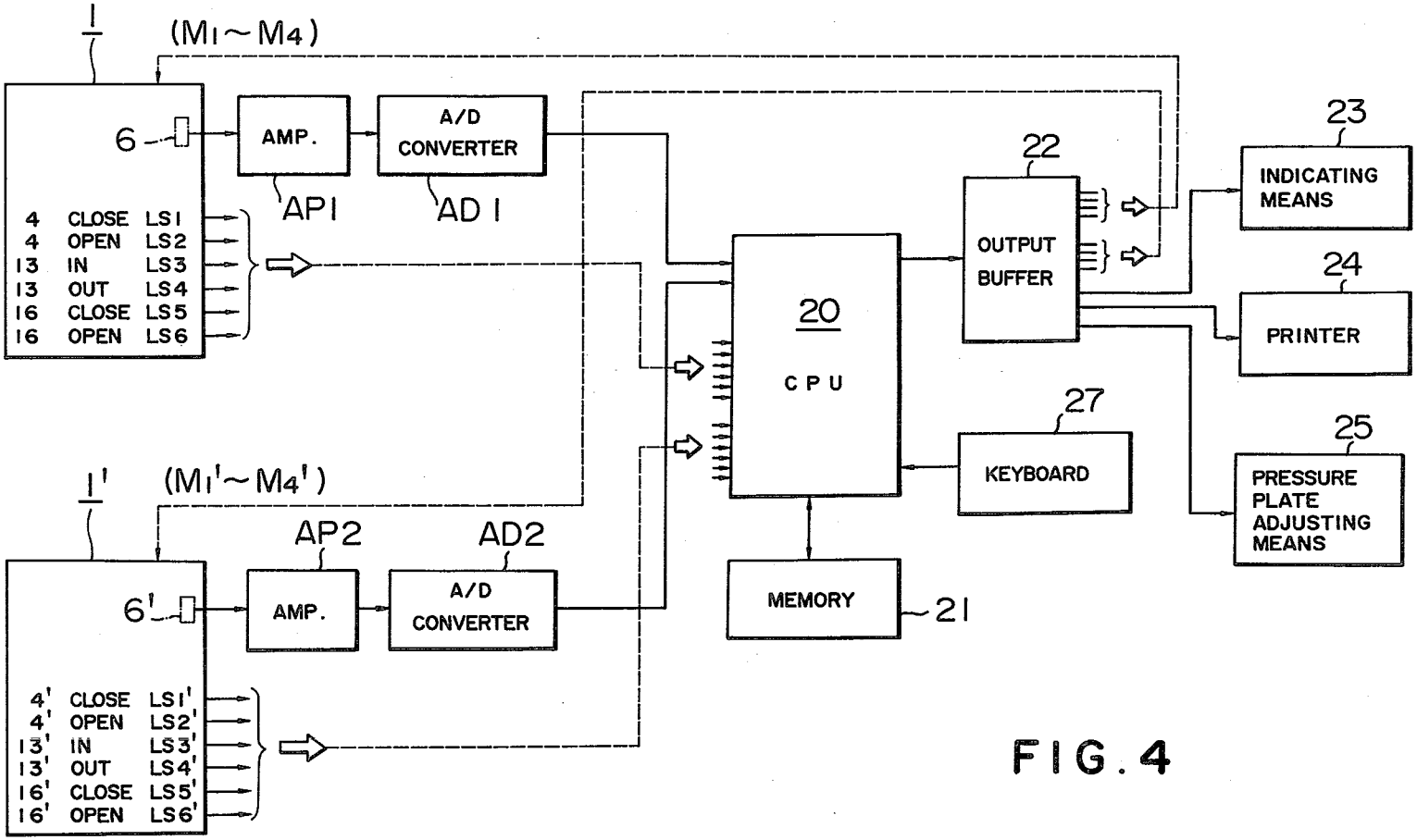
FIG. 4 is a block diagram of the first embodiment.

FIG. 4 shows a block diagram of the first embodiment of the present invention. The outputs from the reflected light receiving sensors 6, 6′ in the sensor means 1, 1′ are respectively amplified by amplifiers AP1, AP2, then converted into digital signals by A/D converters AD1, AD2 and input to the CPU 20. The limit switches LS1–LS6, LS1′–LS6′ for detecting the opening or closing of the inlet shutters 4, 4′ and the light shutters 16, 16′ and for detecting the moving in or out of the reference plates 13, 13′ are also connected to the input side of the CPU 20. Also connected to the CPU 20 are a memory 21 and a keyboard 27 through which an adjusting signal, a measurement-start signal, a predetermined milling degree and a dark current correction value can be input.

On the other hand, signals are sent from an output buffer 22 to the respective motors M1–M4, M1'–M4' for moving the inlet shutters 4 and 4', the reference plates 13 and 13', the rotary discharge valves 15, 15' and the light shutters 16, 16'. The milling degree and the whiteness degree, etc. calculated at the CPU 20 are indicated on the indicating means 23 and also printed out on a printer 24 through the output buffer 22. Also, at the CPU 20, the calculated milling degree is compared against the predetermined milling degree. Therefore, when a discrepancy between the calculated milling degree and the predetermined milling degree is detected, the CPU 20 outputs a signal to the pressure plate adjusting means 25 which controls a weight for a pressure plate of the rice whitening unit. The details of the pressure plate adjusting means have been disclosed in the U.S. patent application Ser. No. 517,762 filed on July 27, 1983 now U.S. Pat. No. 4,463,665, in the names of Toshihiko SATAKE, Kiyoto KAGAWA and Shigeru ARIJI.

Figure 5:
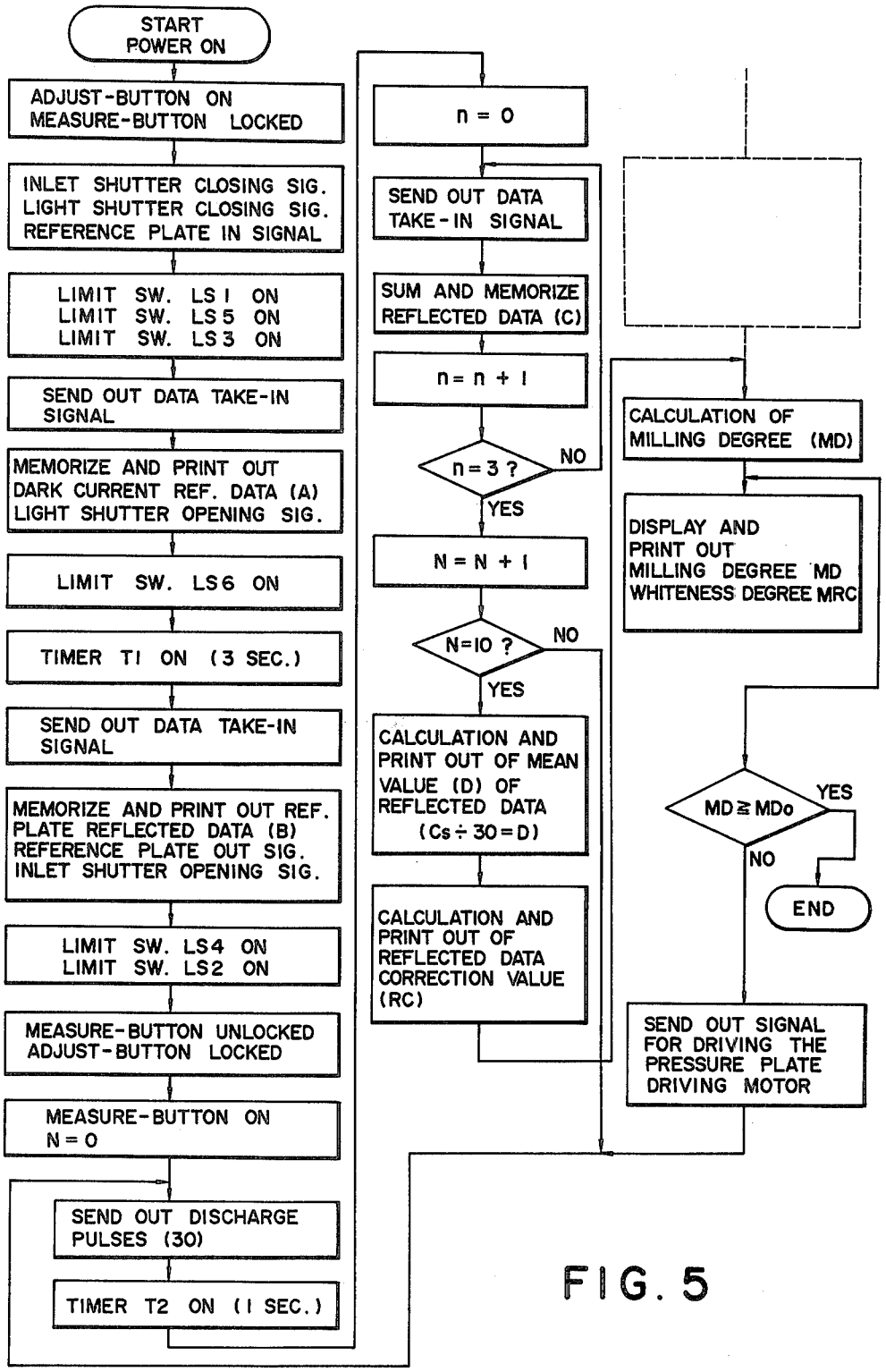
FIG. 5 is a flow chart of the operation of the first embodiment of the invention as illustrated in FIG. 4.

Next, the operation of the above described embodiment of the present invention will be explained hereinbelow with reference to the flow chart given in FIG. 5.

When the power is switched on and an adjustment button on the keyboard 27 is pressed, a measurement button on the same is locked. The CPU 20 sends out signals for closing the inlet shutter 4 and the light shutter 16 as well as a signal for moving-in the reference plate 13 to the testing area. In response to these signals the respective motors M1, M4 and M2 rotate until the CPU 20 receives "ON" signals detected by the respective limit switches LS1, LS5 for detecting the closing of the inlet shutter 4 and the light shutter 16 and the limit switch LS3 for detecting the moving-in of the reference plate 13 to the testing area. Then, the CPU 20 sends out a data take-in signal and starts the measurement operation. That is, the signal from the reflected light receiving sensor 6 is input to the CPU 20 through the amplifier AP1 as well as the A/D converter AD1 and is memorized in the memory 21 as a dark current reflected data A. This data A is printed out on the printer 24.

Next, the CPU 20 sends out a signal for opening the light shutter 16. The motor M4 rotates in response to this signal and when the CPU 20 receives an "ON" signal from the limit switch LS6 for detecting the opening of the light shutter 16, it stops the operation of the motor M4 and sets a timer T1 to "ON" state. When the timer T1 runs out (in approximately 3 seconds), the CPU 20 sends out a data take-in signal again and the data from the reflected light receiving sensor 6 is memorized in the memory 21 as was done with the dark current reflected data A. In this case where the light shutter 16 is opened and the reference plate 13 is moved in, as the light from the light source lamp 11 is reflected at the reference plate 13 and enters into the sensor 6, the data measured thereat is memorized in the memory 21 as a reference plate reflected data B. This data B is also printed out on the printer 24. The CPU 20 then sends out a signal for moving out the reference plate 3 and a signal for opening the inlet shutter 4 whereby the motors M2, M1 start rotating, and the reference plate 13 is moved out from the testing area while the inlet shutter 4 is opened. When the respective limit switches LS4, LS2 detect the moving out of the reference plate 13 and the opening of the inlet shutter 4, the motors M2, M1 stop their operation. Then, the measurement button is released from the locked state while the adjustment button is locked. When the measurement button is pressed at this point, firstly a counter N in the CPU 20 is set or cleared to "0", a predetermined number of discharging pulses (for example, 30 pulses) are sent out to the pulse motor M3 for rotating the rotary discharge valve 15 so that the rotary discharge valve 15 is rotated a predetermined angle (for example, 54 degree) and a timer T2 is set to "ON" state. When this timer T2 runs out (in approximately one second), a counter n is cleared to "0". A data take-in signal is sent out and the data signal from the reflected light receiving sensor 6 is taken into the CPU 20 through the amplifier AP1 as well as the A/D converter AD1 and memorized in the memory 21 as reflected data C, and one "1" is added to the counter n. A data take-in signal is again sent out whereby a fresh piece of reflected data C is measured in the same manner as above and added to the reflected data already memorized in the previous procedure. The measurement and addition of the reflected data continue until the counter n reaches "3" according to the above procedure. In other words, the measurement operation is repeated three times and the respective data thus obtained are added and memorized in the memory 21. When the counter n reaches "3", one "1" is added to the counter N.

When the number at the counter N is not yet "10", then the predetermined number of discharging pulses are sent again to the pulse motor M3 with the consequence that the rotary discharge valve 15 is rotated at the predetermined angle and the timer T2 is again set to "ON" state as was done before each time. When the timer T2 runs out, the counter n is cleared to "0" and a fresh piece of reflected data C is again taken-in whereupon the taken-in data is added to the data already memorized. Here again, the measurement operation is repeated three times and the reflected data thus obtained are summed as was done in the previous cyclic procedure. Further, one "1" is added to the counter N and the same cyclic procedure as explained above continues until the counter N reaches "10". That is, the measurement is repeated three times for the same testing rice and the reflected data C obtained for each of the three times with such testing rice are added. The rotary discharge valve 15 is rotated to change the testing rice in the testing area for the three measurements and summing up of the measured data. This cyclic procedure is repeated ten times. As a consequence, the data of the three measurements with respect to the ten different units of the testing rice are added and the data resulting from the total of the 30 measurements are added and memorized as the reflected data Cs.

The above reflected data Cs obtained according to the procedure as explained above is then divided by 30 to obtain the mean value D of the reflected data, which is printed out on the printer 24. With this data D, together with the dark current reflected data A and the reference plate reflected data B which were already obtained and memorized, and a reference reflected value X (the amount of light reflected from the given total amount of the light (a) incident on the reference plate 13) for the reference plate 13 and a correction value Z (dependent upon the characteristics of the integrating sphere 7) which were input from the keyboard 27, the calculation of a reflected data correction value RC is made based on the below-mentioned equation and the calculated value RC is printed out.

$$RC=X(D-A-Z)/(B-A-Z)$$

The above described processing takes place in both the first sensor means 1 for brown rice and the second sensor means 1' for milled rice. Therefore, the reflected data correction value BRC for brown rice and the refleced data correction value MRC for milled rice are obtained, respectively.

With the use of the values obtained as above and the various coefficients having been input through the keyboard 27, the degree of milling MD of the rice in the whitening unit is calculated according to the following equation:

$$MD=\alpha(MRC-BRC)\cdot 100/(a-BRC\cdot\alpha)$$

wherein a: Total amount of emitted light $\alpha$: Reflection coefficient set according to kinds of grains The milling degree MD thus obtained is indicated on the indicating means 23. And, the reflected data correction value for milled rice MRC obtained based on the data from the sensor means 1' according to the above equation wherein the reference reflected value X is assumed to be 100 is also indicated as the degree of whiteness in percentage. The degree of milling and the degree of whiteness are also printed out on the printer 24.

On the other hand, the calculated degree of milling MD is compared with the predetermined degree of milling MDO. When the value of the former is smaller than that of the latter, a signal is sent to the pressure plate adjusting means 25 (see FIG. 4) and a driving motor therein operates to adjust the weight for the pressure plate so as to increase the degree of milling of the rice being milled. In this case, the sensor means 1' for the milled rice alone is operated and the above-mentioned reflected data is calculated with respect to the milled rice alone. The above operation is repeated until the degree of milling thus calculated reaches the predetermined value MDO and at the point when the degree of milling reaches the predetermined value the weight for the pressure plate is fixed at this value.

It is possible to use a timer when the reflected light is measured by the sensor means 1, 1'. In such a case, the measurement is repeated in a regular interval and each time the degree of milling, etc. are displayed and the necessary adjustment of the degree of milling may be effected.

As explained above, this first embodiment of the present invention enables to have the milling degree and the whiteness degree of the rice displayed and makes it possible to mill the rice automatically to a desired of milling once such a degree is pre-set.

Next, the second embodiment of the present invention will be explained hereunder with a reference to FIGS. 6, 7 and 8.

Figure 6:
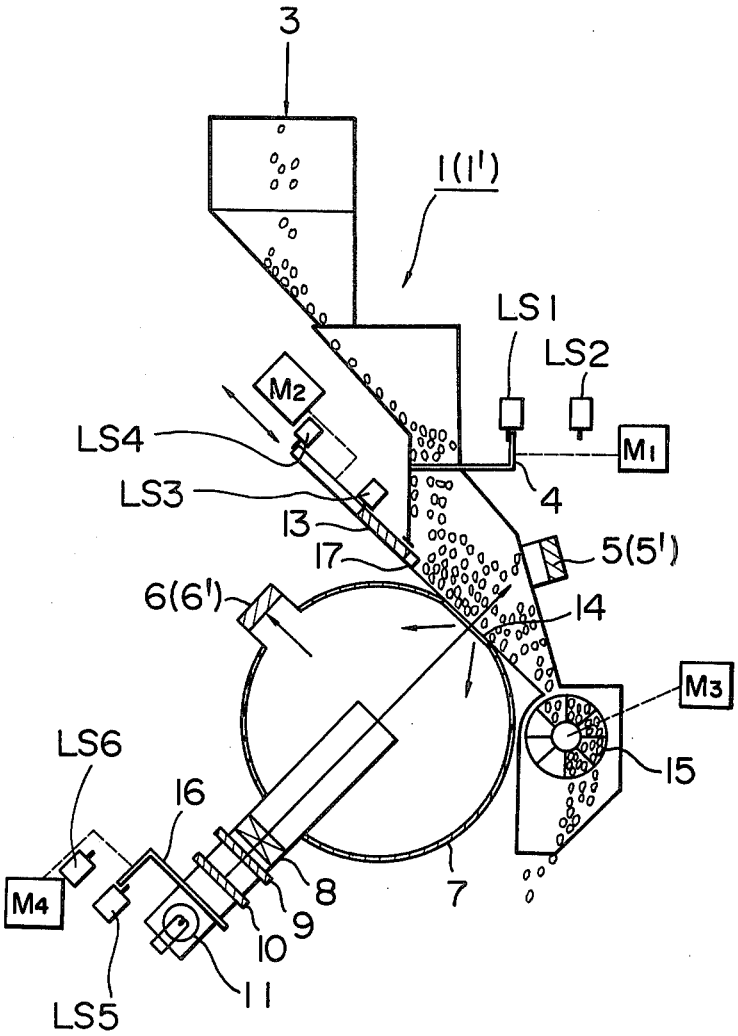
FIG. 6 is a diagrammatic view of the second example of the sensor means used in the second embodiment.

FIG. 6 diagrammatically illustrates the sensor means 1 of the second example of the present invention which is different from the sensor means shown in FIG. 2 in that the degree of transmitted light is to be measured in addition to the degree of reflected light. The sensor means 1' has the same construction as the sensor means 1.

The sensor means 1 shown in FIG. 6 is substantially the same as the sensor means of the above described first embodiment as shown in FIG. 2 except for the arrangement that, while the latter is provided with the reflected light receiving sensor 6 only, the former is provided not only with the reflected light receiving sensor 6 but also a transmitted light receiving sensor 5 for receiving a light transmitted through the infrared absorption filter 10, the monochromatic light filter 9, the converging lens 8 and the rice grains to be tested.

The like elements appearing in FIG. 6 have the like functions of the elements appearing in FIG. 2 and, therefore, the description concerning such elements will not be repeated here.

Figure 7:
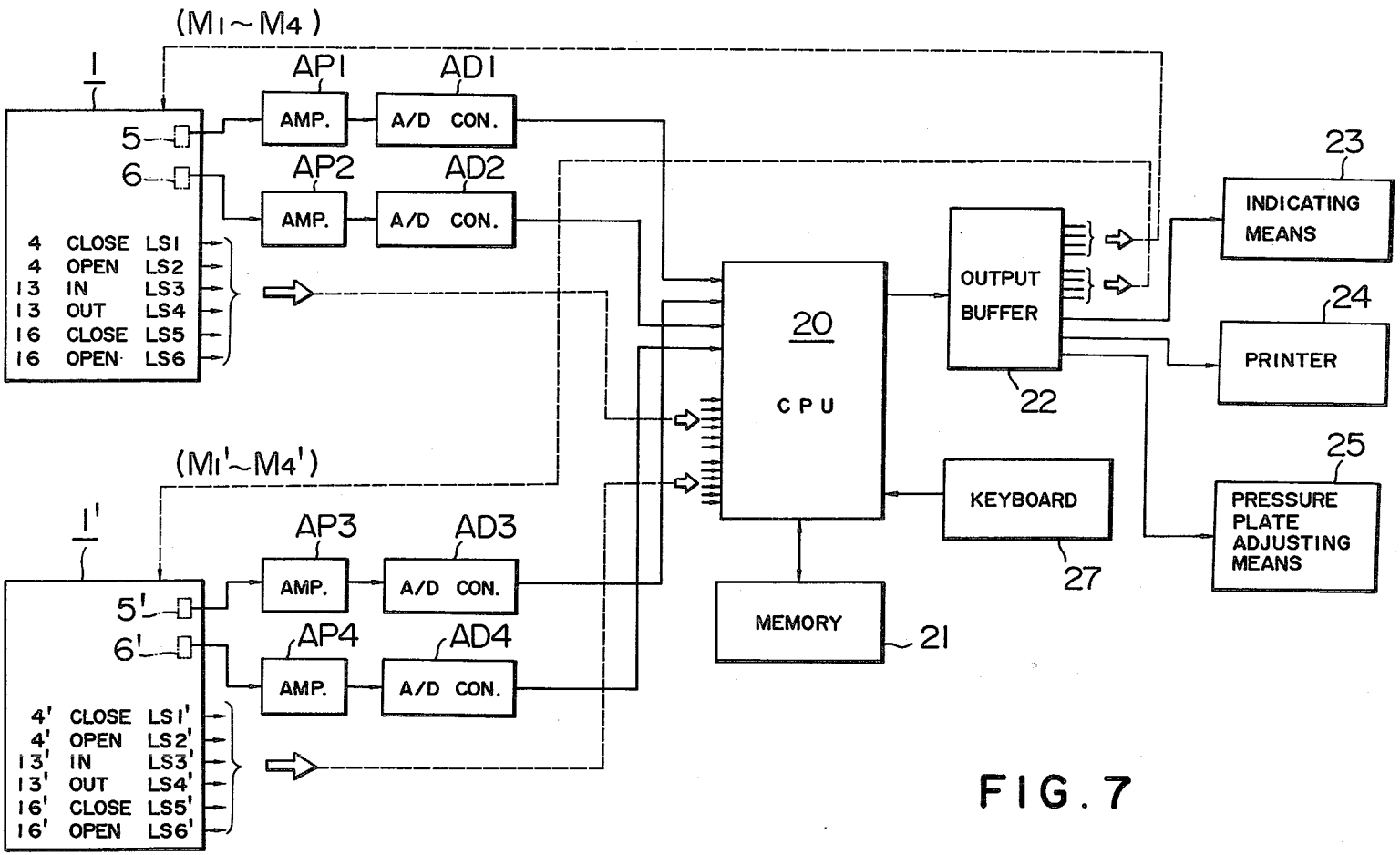
FIG. 7 is a block diagram of the second embodiment.

FIG. 7 is a block diagram of the second preferred embodiment of the present invention. The outputs from the transmitted light receiving sensors 5, 5' and the reflected light receiving sensors 6, 6' in the sensor means 1, 1' are respectively amplified by amplifiers AP1–AP4, converted into digital signals by A/D converters AD1–AD4 and input to the CPU 20.

Figure 8:
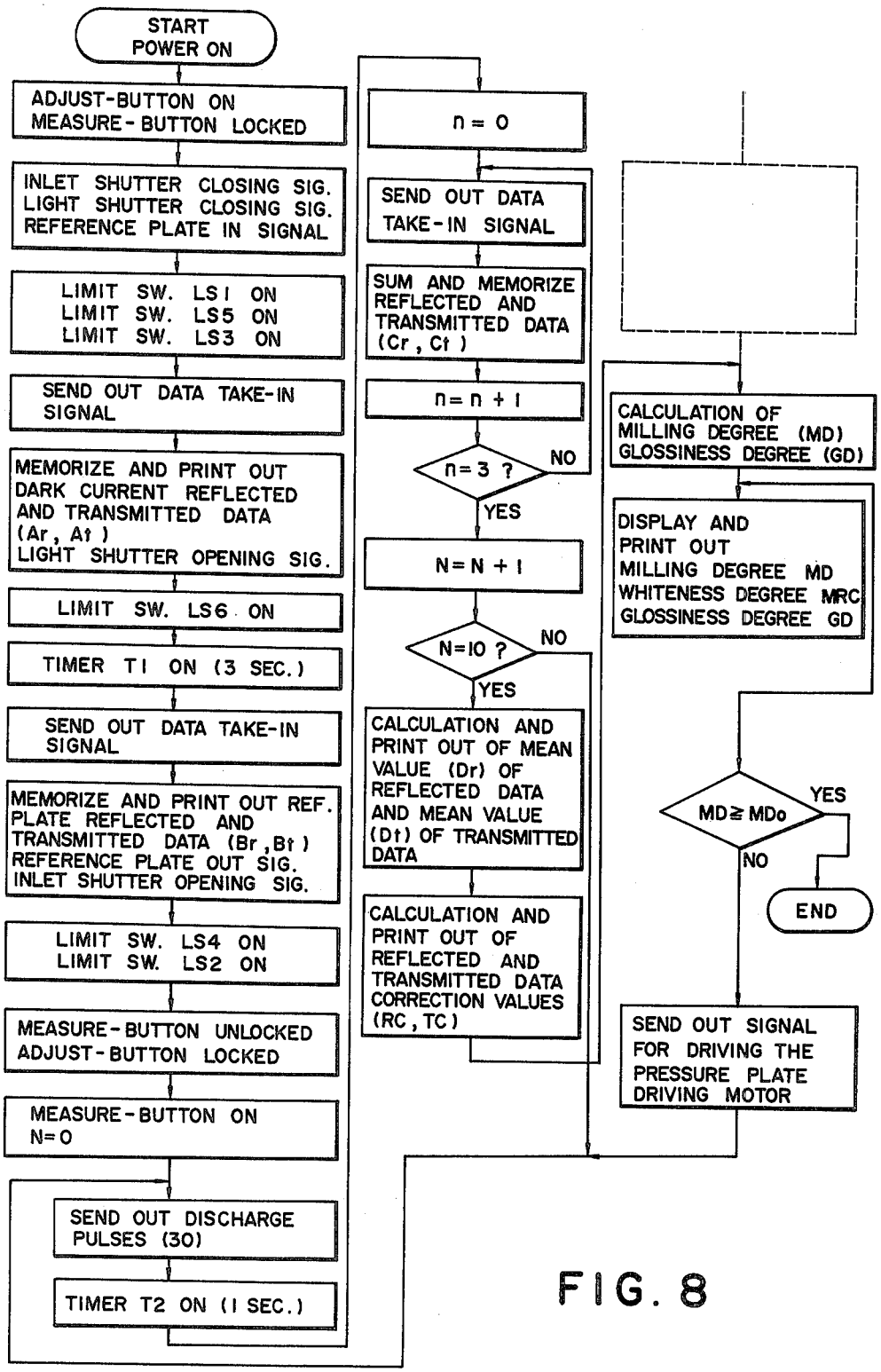
FIG. 8 is a flow chart of the operation of the second embodiment of the invention as illustrated in FIG. 7.

FIG. 8 is a flow chart illustrating the operation of this second embodiment of the present invention.

When the power is switched on and the adjustment button on the keyboard 27 is pressed, the measurement button is locked. The CPU 20 sends out signals for closing the inlet shutter 4 and the light shutter 16 as well as a signal for moving-in the reference plate 13 to the testing area. The CPU 20 then sends out a data take-in signal and starts the measurement operation. As a consequence, the signals from the reflected light receiving sensor 6 and the transmitted light receiving sensor 5 are input to the CPU 20 through the amplifiers AP1, AP2 and the A/D converters AD1, AD2 and are memorized in the memory 21 as a dark current reflected data Ar and a dark current transmitted data At. These data Ar and At are printed out on the printer 24.

Next, the CPU 20 sends out a signal for opening the light shutter 16 and then sets the timer T1 to "ON" state. When the timer T1 runs out (in approximately 3 seconds), the CPU 20 sends out a data take-in signal and the data from the reflected light receiving sensor 6 and the transmitted light receiving sensor 5 are memorized in the memory 21 as a reference plate reflected data Br and a reference plate transmitted data Bt as was done with the dark current data Ar and At. These data Br and Bt are also printed out on the printer 24. The CPU 20 then sends out a signal for moving out the reference plate 13 and a signal for opening the inlet shutter 4 and, upon completion of this operation, the measurement button is released from the locked state while the adjustment button is locked. When the measurement button is pressed, firstly the counter N in the CPU 20 is set or cleared to "0", a predetermined number of discharging pulses (for example, 30 pulses) are sent out to the pulse motor M3 for rotating the rotary discharge valve 15 so that the rotary valve 15 is rotated a predetermined angle (for example, 54 degree) and a timer T2 is set of "ON 38 state. When this timer T2 runs out (in approximately one second), the counter n is cleared to "0". A data take-in signal is sent out and the data signal from the reflected light receiving sensor 6 is taken into the CPU 20 through the amplifier AP2 as well as the A/D converter AD2 and is memorized in the memory 21 as a reflected data Cr. In the same manner, the signal from the transmitted light receiving sensor 5 is memorized in the memory 21 as a transmitted data Ct. One "1" is added to the counter n. A data take-in signal is again sent out and, in the same manner as above, the taken-in reflected data Cr and the transmitted data Ct are added to the reflected data Cr and the transmitted data Ct already memorized. Following this procedure, the measurement and addition continue until the counter n reaches "3". In other words, the measurement operation is repeated three times and the data thus obtained are added and memorized in the memory 21. When the counter n reaches "3", one "1" is added to the counter N.

When the number at the counter N is not yet "10", then a predetermined number of discharging pulses are sent again to the pulse motor M3 with the consequence that the rotary discharge valve 15 is rotated at the predetermined angle and the timer T2 is again sent to "ON" state. The measurement is repeated three times for the newly introduced testing rice and the reflected data Cr and the transmitted data Ct obtained for each of the three times with such testing rice are added and memorized. The data of the three measurements with respect to the ten different units of the testing rice are added and the data resulting from the total of the 30 times of measurements are added and memorized as the reflected data Crs and Cts.

The reflected data Crs and the transmitted data Cts obtained according to the procedure as explained above are respectively divided by 30 to obtain a mean value Dr of the reflected data and a mean value Dt of the transmitted data, and these values are printed out. With these data Dr and Dt, together with the dark current reflected data Ar, the dark current transmitted data At, the reference plate reflected data Br and the reference plate transmitted data Bt which were already obtained and memorized, and a reference reflected value X (the amount of light reflected from the given total amount of light (a) incident on the reference plate 13), a reference transmitted value Y (the amount of light transmitted from the given total amount of light (a) incident on the reference plate 13) for the reference plate 13 and a correction value Z (dependant upon the characteristics of the integrating sphere 7) which were input from the keyboard 27, the calculation of a reflected data correction value RC and a transmitted data correction value TC is made based on the below-mentioned equations and these values are printed out.

$$RC=X(Dr-Ar-Z)/(Br-Ar-Z)$$

$$TC=Y(Dt-At)/(Bt-At)$$

The above described processing takes place in both the first sensor means 1 and the second sensor means 1' and the reflected data correction value BRC for brown rice, the transmitted data correction value BTC for brown rice, the reflected data correction value MRC for milled rice and the transmitted data correction value MTC for milled rice are obtained, respectively.

With the use of the values obtained as above and the various coefficients having been input from the keyboard 27, the degree of milling MD and the degree of glossiness GD of the rice in the whitening unit are calculated according to the following equations:

$$MD=((J1-J2)/J1)\cdot 100$$

$$GD=MTC/(MRC\cdot\delta+e)$$

$$J1=(a-BRC\cdot\alpha-BTC\cdot\beta/(\gamma\cdot f)$$

$$J2=(a-MRC\cdot\alpha-MTC\cdot\beta/(\gamma\cdot f))$$

wherein (a): Total amount of emitted light
$\alpha$: Reflection coefficient
$\beta$: Transmission coefficent
$\gamma$: Attenuation coefficient
$\delta$Glossiness coefficient (These $\alpha$, $\beta$, $\gamma$, and $\delta$ are set according to kinds of grains)
e: Glossiness correction value
f: Attenuation correction value
These e and f are dependent upon the mechanical characteristics)

The milling degree MD and the Glossiness degree GD thus obtained are indicated on the indicating means 23. And, the reflected data correction value for milled rice MRC obtained based on the data from the sensor means 1' according to the above equation wherein the reference reflected value x is assumed to be 100 is indicated as the degree of whiteness in percentage. The degree of milling and the degee of whiteness are also printed out on the printer 24.

The degree of milling MD calculated is compared with the predetermined degree of milling MDO. When the value of the former is smaller than that of the latter, a signal is sent to the pressure plate adjusting means 25 (see FIG. 7) and a driving motor therein operates to adjust the weight for the pressure plate so as to increase the degree of milling of the rice being milled. In this case, the sensor means 1' for the milled rice alone is operated and the reflected data and the transmitted data are calculated with respect to the milled rice alone. The above operation is repeated until the degree of milling thus calculated reaches the predetermined value MDO and at the point when the degree of milling reaches the predetermined value the weight for the pressure plate is fixed at this value.

It is possible to use a timer when the reflected light and the transmitted light are measured by the sensor means 1, 1'. In such a case, the measurement is repeated in a regular interval and each time the degree of milling, etc. are displayed and the necessary adjustment of the degree of milling may be effected.

As explained above, this second embodiment of the present invention enables to have the milling degree, the whiteness degree and further the glossiness degree of the rice displayed and makes it possible to mill the rice automatically to a desired degree of milling once such a degree is pre-set.

While the invention has been described in its preferred embodiments, it is to be distinctly understood that the invention is not limited thereto but may be otherwise variously embodied within the scope of the following claims.

What is claimed is:

1. A rice whitening apparatus comprising, a rice whitening unit;

a first sensor means provided at a brown rice side of said rice whitening unit, including a first reflected light receiving sensor for measuring a degree of reflected light from the brown rice;

a second sensor means provided at a milled rice side of said rice whitening unit, including a second reflected light receiving sensor for measuring a degree of reflected light from the milled rice;

a calculating means coupled with said first sensor means and second sensor means for calculating a degree of milling of the rice based on the degree of reflected light from said first and second sensor means; and an indicating means coupled with said calculating means for indicating the degree of milling calculated by said calculating means.

2. A rice whitening apparatus according to claim 1, in which said first sensor means includes a first transmitted light receiving sensor for measuring a degree of transmitted light from the brown rice; said second sensor means includes a second transmitted light receiving sensor for measuring a degree of transmitted light from the milled rice; and said calculating means coupled with said first sensor means and said second sensor means calculates a degree of milling of the rice based on the degree of both reflected and transmitted light from said first and second sensor means.

3. A rice whitening apparatus according to claim 1, in which said apparatus further comprises, a comparing means coupled with said calculating means, for comparing the degree of milling calculated by said calculating means against a predetermined degree of milling; and a pressure plate adjusting means coupled with said comparing means, for being operated to meet the predetermined degree of milling based on an output of said comparing means.

4. A rice whitening apparatus according to claim 2, in which said apparatus further comprises, a comparing means coupled with said calculating means, for comparing the degree of milling calculated by said calculating means against a predetermined degree of milling; and a pressure plate adjusting means coupled with said comparing means, for being operated to meet the predetermined degree of milling based on an output of said comparing means.

5. A rice whitening apparatus according to claim 1, in which said indicating means is capable of indicating also a degree of whiteness of the rice obtained in the course of calculating the degree of milling of the rice.

6. A rice whitening apparatus according to claim 3, in which said indicating means is capable of indicating also a degree of whiteness of the rice obtained in the course of calculating the degree of milling of the rice.

7. A rice whitening apparatus according to claim 2, in which said indicating means is capable of indicating also a degree of whiteness and a degree of glossiness of the rice obtained in the course of calculating the degree of milling of the rice.

8. A rice whitening apparatus according to claim 4, in which said indicating means is capable of indicating also a degree of whiteness and a degree of glossiness of the rice obtained in the course of calculating the degree of milling of the rice.

* * * * *